United States Patent [19]

Simard

[11] Patent Number: 4,776,476

[45] Date of Patent: Oct. 11, 1988

[54] CLOSURE ASSEMBLY

[76] Inventor: Laval Simard, 893 Des Rochers, St. Felicien, Quebec, Canada, G0W 2N0

[21] Appl. No.: 105,377

[22] Filed: Oct. 7, 1987

Related U.S. Application Data

[63] Continuation-in-part of Ser. No. 945,009, Dec. 22, 1986, abandoned.

[51] Int. Cl.[4] ..... B65D 41/34

[52] U.S. Cl. ..... 215/230; 215/253; 215/278; 215/295

[58] Field of Search ..... 215/232, 251, 253, 230, 215/277, 278, 328, 295, 252

[56] References Cited

U.S. PATENT DOCUMENTS

| | | | |
|---|---|---|---|
| 1,882,359 | 10/1932 | Greenhouse | 215/251 |
| 2,198,117 | 4/1940 | Kancer | 215/251 |
| 2,390,291 | 12/1945 | Blackman | 215/252 |
| 3,232,469 | 2/1966 | Piazze | 215/251 |
| 3,253,729 | 5/1966 | Virany | 215/278 |
| 3,272,367 | 9/1966 | Long | 215/251 |
| 3,514,004 | 5/1970 | Hammersmith | 215/328 |
| 4,627,548 | 12/1986 | Thompson | 215/295 |
| 4,702,383 | 10/1987 | Wender | 215/252 X |

FOREIGN PATENT DOCUMENTS

| | | | |
|---|---|---|---|
| 2753239 | 6/1979 | Fed. Rep. of Germany | 215/232 |

*Primary Examiner*—Donald F. Norton
*Attorney, Agent, or Firm*—Larson and Taylor

[57] ABSTRACT

A closure assembly for a container such as a beer bottle, comprising a twist-to-remove crown cap to be mounted on the container, and a cushioning device for hand gripping and twisting off the crown cap. The cushioning device includes a rupturable member overlying the crown cap, and pad means mounted on the crown cap and facing its skirt. The cushioning device provides a protective medium over the sharp projections on the skirt of the crown cap to protect against injury when twisting off the cap.

9 Claims, 1 Drawing Sheet

CLOSURE ASSEMBLY

This is a continuation-in-part of application Ser. No. 945,009, filed Dec. 22, 1986, now abandoned.

FIELD OF THE INVENTION

The present invention relates, in general, to the field of closures for containers and more particularly to a novel closure assembly provided with a twist-to-remove crown cap and a cushioning device to prevent injury to fingers when twisting-off the cap from the container.

BACKGROUND OF THE INVENTION

The conventional method for sealing beer bottles or similar containers resides in providing a crown cap of metallic construction which is crimped into locking relation on the pouring mouth of the container. These, necessitate the use of a tool or bottle opener to uncrimp and remove the crown cap from the bottle, which obviously constitutes a disadvantage.

To solve this problem it has been suggested to use a twist-off crown cap threadedly engaged on the neck of the bottle that can be removed by hand without using a bottle opener or the like. However, this design suffers from a disadvantage in that the sharp projections on the skirt of the crown cap can cause injuries to fingers when attempting to twist-off the cap, and to the best knowledge of the present inventor, no satisfactory solution has been found to this problem yet.

Furthermore, containers with twist-off crown caps are prone to tampering because such closures can be removed and installed back on the container without causing any apparent damage to warn that the container has been tampered with.

OBJECT AND STATEMENT OF THE INVENTION

An object of this invention is an improved closure assembly of a type including a twist-off cap, that can reduce and substantially eliminate injury during removal of the cap by hand.

The object of this invention is achieved by providing a closure assembly including a twist-to-remove crown cap to be crimped on the neck of a bottle or a similar container for closing the pouring mouth of the container. The crown cap includes a flat top wall and a depending skirt provided with sharp projections resulting from the crimping operation of the cap on the bottle.

The closure assembly also comprises a cushioning device for hand gripping and twisting-off the crown cap providing a protective medium over the sharp projection against injury to fingers. The cushioning device includes a rupturable element, preferably in the form of a strip made of paperlike or cardboard material, attached to the container, preferably by means of an adhesive, and overlying the crown cap so that the latter cannot be removed without either severing the strip or breaking the adhesive bond between the strip and the container. Pads of resilient material such as rubber, are mounted to the strip and face the skirt of the crown cap.

In a preferred embodiment, the rupturable element comprises a laminated strip including a pair of layers of paperlike or cardboard material, and between the layers are mounted the pads of resilient material, the strip being adhesively mounted to the container.

It should be appreciated that the strip fulfills a dual function, namely, it maintains the pads of resilient material in registry with the skirt of the crown cap to prevent the sharp projections to be exposed and avoids direct contact with fingers during removal of the cap, and at the same time it makes any tampering or unauthorized opening of the container clearly visible.

Preferably, the strip is provided with a series of perforations defining one or more tear lines to facilitate rupture of the strip during removal of the crown cap.

Therefore, the present invention comprises in a broad aspect a closure assembly for a container having a neck defining an opening of the container, the closure assembly comprising:

a twist-to-remove crown cap adapted to be mounted on the neck for closing the opening, the crown cap including a top wall and a depending skirt provided with a plurality of spaced apart sharp projections;

a cushioning member for hand gripping and twisting-off the crown cap from the container, the cushioning member including:

(a) a rupturable element adapted to be mounted to said container in overlying relation to the crown cap; and (b) pad means mounted to the rupturable element and facing the skirt of the crown cap, the cushioning member forming a protective medium over the sharp projections of the crown cap to protect against injury when twisting-off the crown cap.

DESCRIPTION OF PREFERRED EMBODIMENTS

Figure 1:
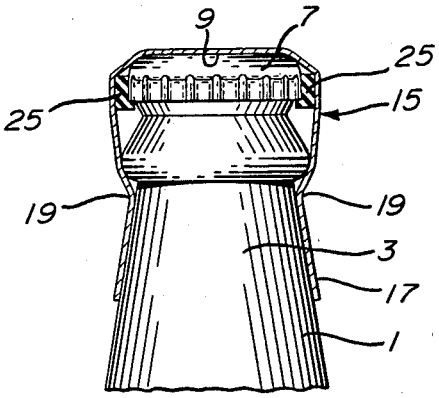
FIG. 1 is an elevational view of the neck of a beer bottle with the closure assembly according to the present invention.
Figure 2:
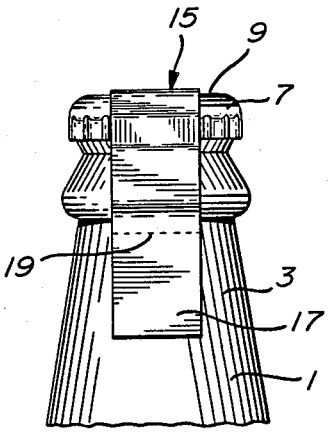
FIG. 2 is a side view of the bottle neck shown in FIG. 1.

Referring now to the drawings, and more particularly to Figure 1, the closure assembly according to the present invention is shown mounted on a beer bottle designated generally by the reference numeral 1 and having a neck 3. A crown cap 7 of metallic construction for closing and sealing the beer bottle 1 is crimped over threads (not shown in the drawings) provided on the upper portion of the neck 3.

The crown cap 7, includes a flat top wall 9 and a depending skirt 11 which is provided with a plurality of sharp projections 13 formed during the crimping operation of the crown cap 7 over the neck 3. The crimping operation produces a threaded engagement between the crown cap 7 and the neck 3 so that the crown cap 7 may be removed by hand without any bottle opener or similar tool, simply by twisting-off the cap.

A cushioning device 15 for hand gripping and twisting-off the crown cap is mounted on the bottle 1. The cushioning device 15 includes a strip 17 of paperlike material such as cardboard, having two ends secured with adhesive material at opposite locations on the neck 1, defining a rupturable element. The strip 17 is in overlying with the crown cap 7 and it is tightly drawn over the latter to prevent removal of the crown cap 7 without breaking the rupturable element, either by severing the strip 17 or breaking the adhesive bond between the strip 17 and the bottle 1. To facilitate severance of the strip 17, a series of perforations are provided defining a pair of tear lines 19.

The cushioning device also includes a pair of pads 25 of resilient material such as rubber, adhesively mounted to the inner face of the strip 17. The pads 25 are positioned on each side of the crown cap and face the skirt thereof to cover the sharp projections 13 in register with the strip 17.

Figure 3:
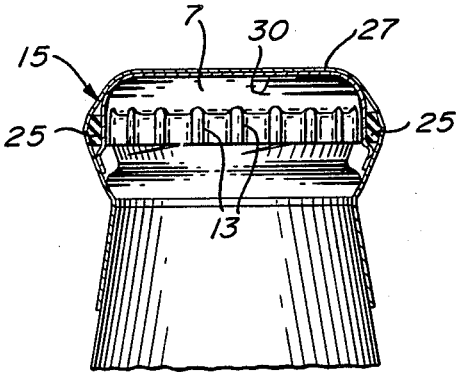
FIG. 3 is a view similar to that of FIG. 1 but of a variant.

FIG. 3 illustrates a variant of the closure assembly according to the invention. The pads 25 of resilient material are integrated into the strip 17 which has a laminated structure, including a pair of layers of paper-like material 27 and 30, adhesively mounted to each other and carrying therebetween the pads 25 of resilient material.

To open the bottle 1, the crown cap is removed by pressing tightly with the fingers over the cushioning device 15 and at the same time twisting-off the cap to sever the strip 17 along the tear lines 19 or breaking the adhesive bond between the strip 17 and the bottle 1. The pads 25 and the strip 17 provide a substantial cushioning effect preventing direct contact between the fingers and the sharp projections 13 to protect against injury. Furthermore, the strip 17 acts as seal to warn against tampering or unauthorized opening of the bottle.

Various modifications of the closure assembly described above may be made without departing from the spirit of the invention. For example, it may be envisaged to provide on the portion of the strip 17, over the crown cap 7 a scratch game consisting of a seat of markings or indicias covered by a layer of opaque paint that may be scratched away with a finger nail to uncover the indicias. If the indicias are in a predetermined sequence, or certain type of indicias are present, a price is won. Such scratch games are commonly used in lotteries today.

Although the invention has been described above with respect to specific forms, it will be evident to persons skilled in the art that it may be refined and modified in various ways. It is therefore wished to have it understood that the present invention should not be limited in interpretation except by the terms of the following claims.

I claim:

1. A closure assembly for a container having a neck defining an opening on said container, said closure assembly comprising:

a twist-to-remove crown cap adapted to be mounted on said neck for closing said opening, said crown cap including a top wall and a depending skirt provided with a plurality of spaced apart sharp projections:

a cushioning member for hand gripping and twisting-off said crown cap from the container, said cushioning member including:

(a) a rupturable element adapted to be mounted to said container in overlying relation with said crown cap; and (b) pad means mounted to said rupturable element and facing said skirt, said cushioning member forming a protective medium over said sharp projections to protect against injury when twisting-off said crown cap.

2. A closure assembly as defined in claim 1, wherein said crown cap is adapted to be threadedly engaged on said neck.

3. A closure assembly as defined in claim 1, wherein said rupturable element comprises an elongated strip having opposite ends mounted at opposite locations on said neck.

4. A closure assembly as defined in claim 3, wherein said strip is made of cardboard material.

5. A closure assembly as defined in claim 3, wherein said pad means is integrated into said strip.

6. A closure assembly as defined in claim 5, wherein said strip has a laminated structure including a pair of layers facing each other, said pad means being interposed between said layers.

7. A closure assembly as defined in claim 3, wherein said strip includes a plurality of perforations defining a tear line.

8. A closure assembly as defined in claim 3, wherein said strip comprises a scratch game.

9. A closure assembly as defined in claim 1, wherein said pad means comprise two pads mounted on opposite sides of said crown cap and facing said skirt.

* * * * *